US005216467A

United States Patent [19]

Esser et al.

[11] Patent Number: 5,216,467

[45] Date of Patent: Jun. 1, 1993

[54] BRUSH-BASED CARRIER BEAD REMOVAL DEVICE FOR A DEVELOPER HOUSING IN A XEROGRAPHIC APPARATUS

[75] Inventors: James R. Esser, Rochester; Wayne A. Morganti, Brockport, both of N.Y.

[73] Assignee: Xerox Corporation, Stamford, Conn.

[21] Appl. No.: 828,098

[22] Filed: Jan. 30, 1992

[51] Int. Cl.[5] ..... G03G 21/00

[52] U.S. Cl. ..... 355/215; 355/245; 355/305; 15/159.1

[58] Field of Search ..... 15/DIG. 6, 159 A, 256.5, 15/256.51, 256.52, 256.53, 256.6; 355/215, 269, 270, 305, 245, 251, 252, 253, 250, 296, 297, 301-304, 298; 118/652, 653, 656-658

[56] References Cited

U.S. PATENT DOCUMENTS

| | | | |
|---|---|---|---|
| 3,614,221 | 10/1971 | Solarek | 355/250 |
| 3,834,804 | 9/1974 | Bhagat et al. | 355/306 |
| 3,894,513 | 7/1975 | Stanley et al. | 118/652 |
| 4,244,074 | 1/1981 | Barcikowski et al. | 15/114 |
| 4,361,922 | 12/1982 | Karal | 15/DIG. 6 |
| 4,400,082 | 8/1983 | Kiba | 15/256.53 X |
| 4,407,219 | 10/1983 | Dellevoet | 15/256.51 X |
| 4,480,351 | 11/1984 | Koffler | 15/DIG. 6 |
| 4,616,919 | 10/1986 | Adley et al. | 355/245 |
| 4,673,284 | 6/1987 | Matsumoto et al. | 15/256.51 X |
| 4,681,426 | 7/1987 | Bean et al. | 355/298 |
| 4,829,338 | 5/1989 | Whittaker et al. | 355/305 |
| 4,861,179 | 8/1989 | Schrepf et al. | 15/DIG. 6 |
| 5,029,316 | 7/1991 | Koiso | 15/256.51 X |
| 5,034,779 | 7/1991 | Newbury | 355/297 |
| 5,128,725 | 7/1992 | Frankel et al. | 355/301 |

FOREIGN PATENT DOCUMENTS

| | | |
|---|---|---|
| 0065872 | 4/1984 | Japan . |
| 0060677 | 4/1985 | Japan . |

*Primary Examiner*—A. T. Grimley
*Assistant Examiner*—Robert Beatty
*Attorney, Agent, or Firm*—R. Hutter

[57] ABSTRACT

A device prevents the migration of particles from the edge of a moving surface, such as a photoreceptor in an electrophotographic printing apparatus. A brush in contact with an edge of the surface includes fibers of a first type, and fibers of a second type. The fibers of the second type are less resilient than those of the first type and substantially incapable of abrading the surface. The brush guides the particles toward a bead-removal device.

16 Claims, 5 Drawing Sheets

BRUSH-BASED CARRIER BEAD REMOVAL DEVICE FOR A DEVELOPER HOUSING IN A XEROGRAPHIC APPARATUS

FIELD OF THE INVENTION

This invention relates to an electrophotographic printing apparatus having a removal or pickoff device for removing carrier particles which adhere to a charge retentive surface in the apparatus during development.

BACKGROUND OF THE INVENTION

In electrophotographic applications such as xerography, a charge retentive surface is electrostatically charged, and then exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals, where a charged surface may be imagewise discharged in a variety of ways.

Developing material commonly used in systems for developing latent images on the charge retentive surface typically comprises a mixture of toner and a "carrier" of larger granular beads of a ferrous material. If the developing system is a magnetic brush assembly, magnetizable carrier beads also provide mechanical control for the formation of magnetic brush bristles so that toner can readily be brought into contact with the charge retentive surface. Toner is attracted to the latent image from the carrier beads to form the toner image. In this type of copier, some carrier beads inevitably adhere to the charge retentive surface after the image is developed. Some of these adhering carrier beads may prevent perfect contact between the substrate and toner image during the transfer step. It is thus essential for optimum operation that carrier beads remaining on the charge retentive surface be removed therefrom. Failure to remove carrier beads from the charge retentive surface results in a characteristic copy quality defect displaying a white area which may have a black dot in the center. The hard carrier beads also have a tendency to abrade and damage the charge retentive surface if not removed prior to reaching the cleaning zone.

Carrier bead removal devices are known, such as, for example, those described in U.S. Pat. Nos. 3,894,513 to Stanley et al. and 3,834,804 to Bhagat et al., which use a stationary magnet within a rotating cylindrical shell to remove the ferrous carrier beads from the photoreceptor for deposit in a sump or for return to the developer housing.

U.S. Pat. No. 4,829,338 to Whittaker et al. describes an apparatus for magnetically picking excess carrier beads off a photoreceptor, using a shunted stationary magnet disposed within a rotating sleeve which contacts the photoreceptor near the exit of the developer housing. The magnet and the rotating sleeve extend across the photoreceptor belt 10, generally transverse to the direction of movement of the photoreceptor belt 10. This "bead removal device," or BRD, is common on many electrophotographic printers currently available, and is also used in conjunction with the present invention, to be described below.

When using a BRD as described above, or any other device for removing carrier beads which are adhering to the photoreceptor, a concern is that a certain number of carrier beads will not be removed, particularly those which adhere in areas near the edges of the photoreceptor. These carrier beads are likely to be outside the effective magnetic range of a BRD. Also, because the beads are near the edges of the photoreceptor, the beads are likely to migrate from the developer housing into the rest of the machine, very probably interfering with the operation of the machine.

It is an object of the present invention to provide a seal disposed at the edges of a moving photoreceptor to substantially reduce migration of carrier beads out of the developer housing.

It is another object to provide such a seal which is satisfactorily efficient, but which will not damage the photoreceptor.

It is another object to provide such a seal which may be manufactured from inexpensive materials.

Other objects will appear hereinafter.

SUMMARY OF THE INVENTION

In accordance with the above-stated objects, the present invention relates to a device for removing particles from a surface and preventing migration of the particles from the developer housing. A brush, in contact with the surface adjacent an edge thereof, includes fibers of a first type and fibers of a second type, with the fibers of the second type being less resilient than those of the first type and substantially incapable of abrading the surface. Means are provided for removing particles from the surface, with the brush being disposed so as to guide the particles to the removing means.

In the preferred embodiment of the invention, in an electrophotographic printing apparatus having a movable photoreceptor surface, a developer for conveying to the photoreceptor surface carrier particles and toner material, and means for removing carrier particles from the photoreceptor surface, a device reduces the migration of carrier particles from the developer housing. A brush disposed between the developer means and the means for removing carrier beads from the photoreceptor surface contacts the photoreceptor surface adjacent an edge thereof. The brush includes fibers of a first type, having an appreciable resilience for urging against the photoreceptor surface, and fibers of a second type, being less resilient than those of the first type and substantially incapable of abrading the photoreceptor surface.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
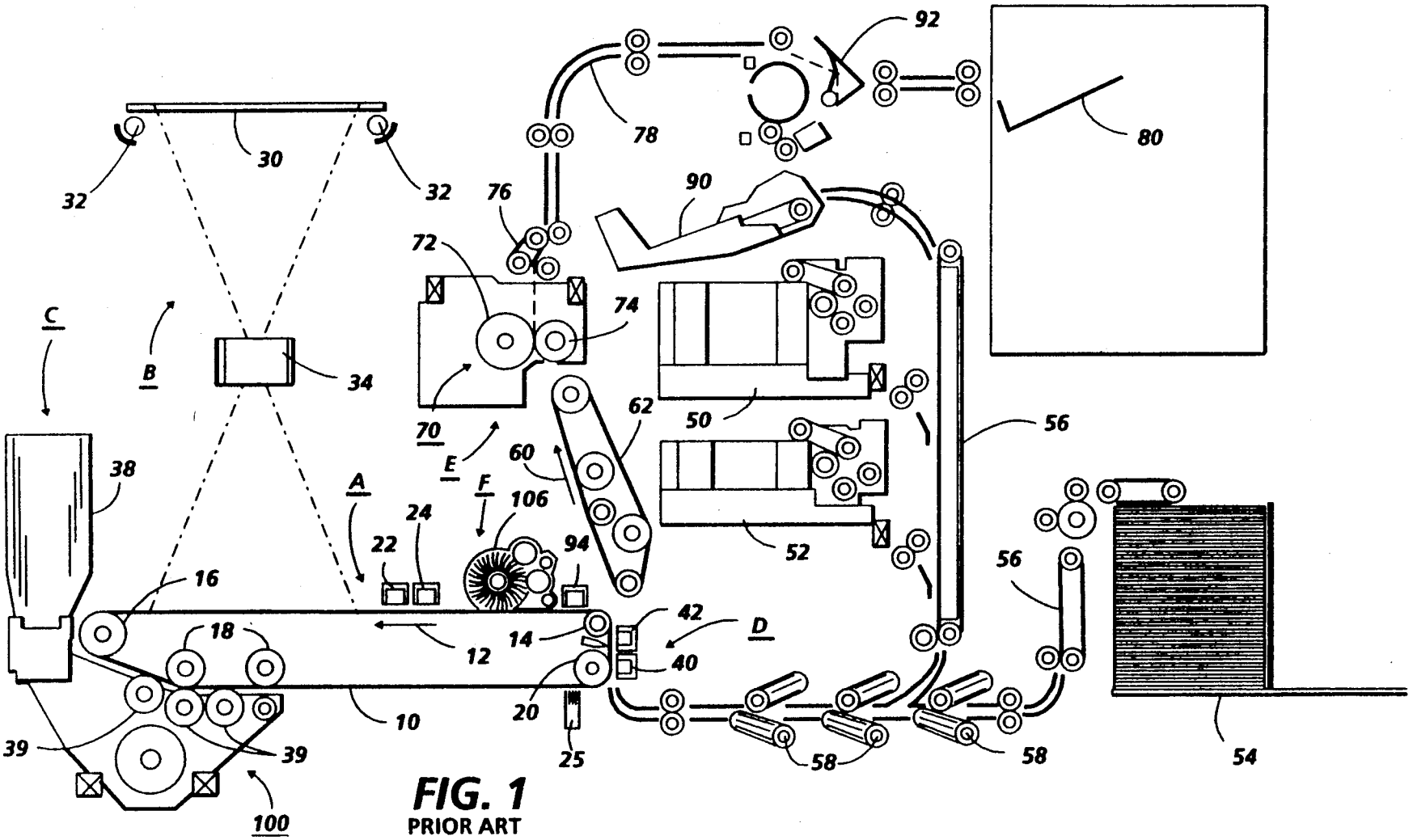
FIG. 1 PRIOR ART
FIG. 1 is a schematic elevational view of an electrophotographic printer, in this case a copier, as would incorporate the present invention.

Referring now to the drawings, for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original. Accordingly, a reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Photoreceptor belt 10 is entrained about stripping roller 14, tension roller 16, idler rollers 18, and drive roller 20. Drive roller 20 is coupled to a motor (not shown) by suitable means such as a belt drive.

Photoreceptor belt 10 is maintained in tension by a pair of springs (not shown) resiliently urging tension roller 16 against belt 10 with the desired spring force. Both idler rollers 18 and tension roller 16 are rotatably mounted. These rollers are idlers which rotate freely as belt 10 moves in the direction of arrow 12. Belt 10, in combination with stripping roller 14, tension roller 16, idler rollers 18, and drive roller 20, forms a "photoreceptor assembly" which, in a typical commercially made copier, may be formed on a pivoting assembly for convenience in servicing, as will become apparent below.

With continued reference to FIG. 1, initially a portion of belt 10 passes through charging station A. At charging station A, a pair of corona devices 22 and 24 charge photoreceptor belt 10 to a relatively high, substantially uniform negative potential. The edge of the photoreceptor belt 10 is typically grounded by a ground brush 25, which is used as part of a "closed-loop" charging system.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, photoreceptor belt 10 advances the electrostatic latent image to development station C. At development station C, a magnetic brush developer unit generally indicated as 38 advances a developer mix (i.e. toner and carrier particles, also known as carrier beads) into contact with the electrostatic latent image with magnetic brushes 39. The latent image attracts toner particles from the carrier granules thereby forming toner powder images on photoreceptor belt 10.

Photoreceptor belt 10 then advances the developed latent image to transfer station D. At transfer station D, a sheet of support material such as paper copy sheet is moved into contact with the developed latent images on belt 10. First, the latent image on belt 10 is exposed to a pre-transfer light from a lamp (not shown) to reduce the attraction between photoreceptor belt 10 and the toner powder image thereon. Next corona generating device 40 charges the copy sheet to the proper potential so that it is tacked to photoreceptor belt 10 and the toner powder image is attracted from photoreceptor belt 10 to the sheet. After transfer, a corona generator 42 charges the copy sheet to an opposite polarity to detack the copy sheet from belt 10, whereupon the sheet is stripped from belt 10 at stripping roller 14.

Sheets of substrate or support material are advanced to transfer station D from supply trays 50, 52 and 54, which may hold different quantities, sizes and types of support materials. Sheets are advanced to transfer station D along conveyors 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets bearing fused images are directed through decurler 76. Chute 78 guides the advancing sheet from decurler 76 to catch tray 80 or a finishing station for binding, stapling, collating etc., and removal from the machine by the operator. Alternatively, the sheet may be advanced to a duplex tray 90 from duplex gate 92 from which it will be returned to the processor and conveyor 56 for receiving second side copy.

A pre-clean corona generating device 94 may be provided for exposing the residual toner and contaminants to positive charges to thereby narrow the charge distribution thereon for more effective removal at rotating electrostatic brush cleaning station F.

As thus described, a reproduction machine in accordance with the present invention may be any of several well known devices. Variations may be expected in specific electrophotographic processing, paper handling and control arrangements without affecting the present invention.

Figure 2:
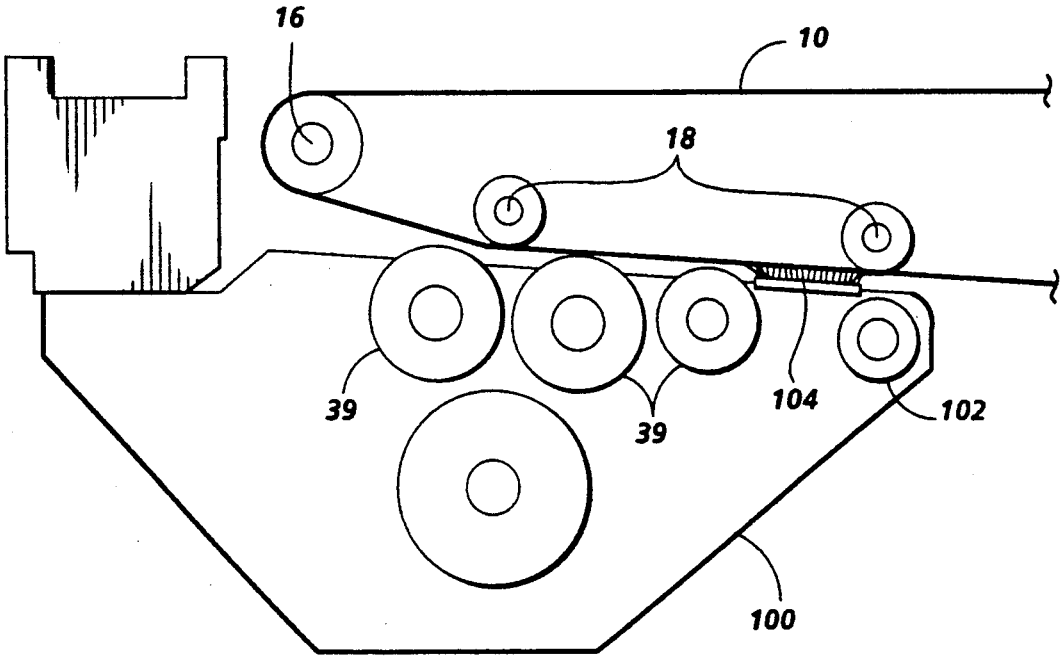
FIG. 2 is an elevational view of a portion of a developer housing incorporating the present invention.
Figure 3:
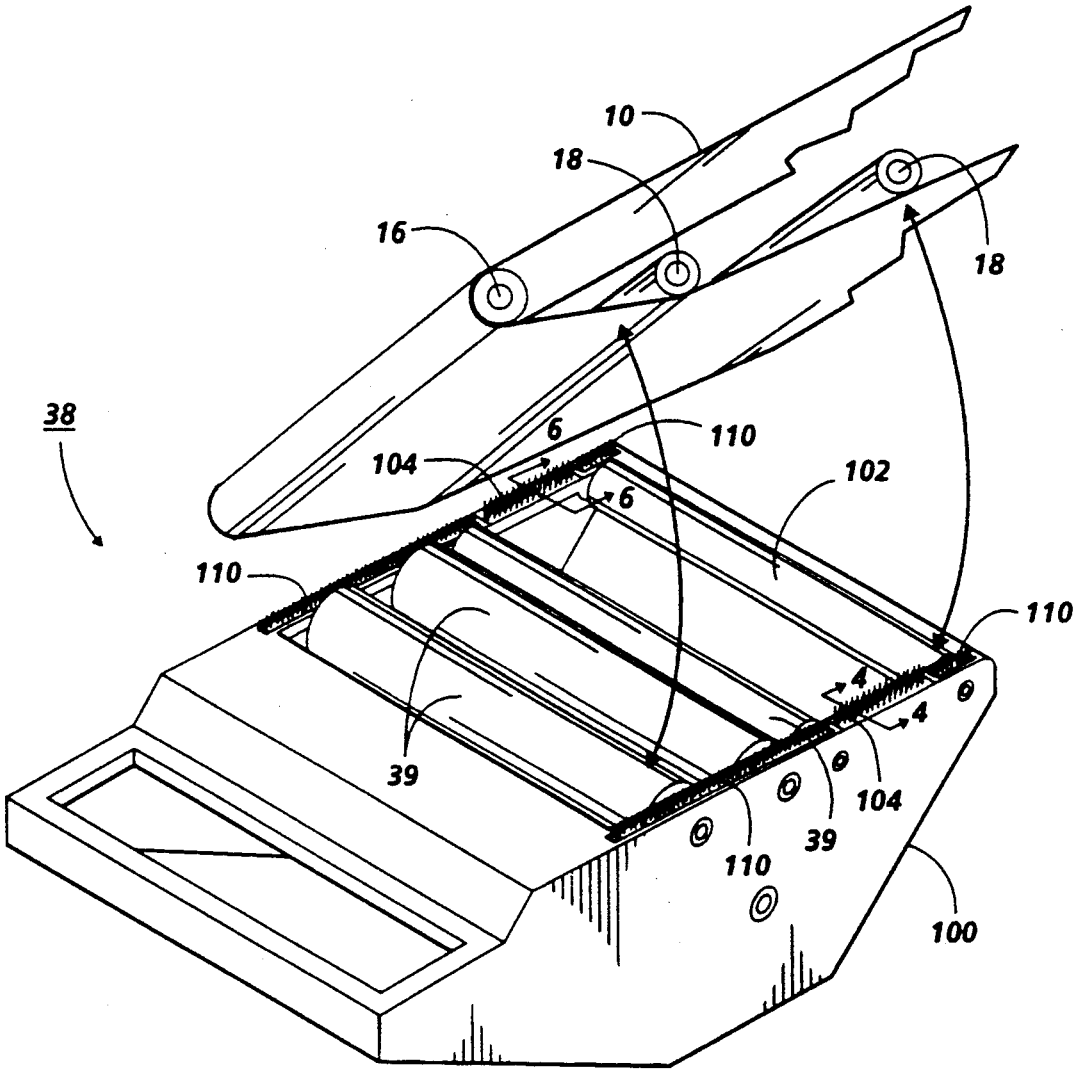
FIG. 3 is a simplified elevational view of a portion of a developer housing, in combination with a photoreceptor assembly in a service position, incorporating the present invention.

FIGS. 2 and 3 are, respectively, side cross-sectional and elevational views of the main portion of a developer housing 100 used in the developing station of the typical electrophotographic printer shown generally in FIG. 1. The developing station includes, in its main parts, a developer housing 100, and, in the present embodiment, three developer rolls 39. The developer rolls 39 are each of the magnetic brush type well known in the art, in which the developer material consists of magnetic carrier particles, also known as carrier beads, upon which smaller toner particles are attracted. The outer surfaces of the developer rolls rotate around stationary magnets (not shown) within each developer roll, and in this way the magnetic carrier beads form magnetic brushes by which toner particles are conveyed to the surface of the photoreceptor. As can be seen in FIG. 2, idler rollers 18 are disposed on the other side of the photoreceptor belt 10, so that the photoreceptor is held closely to the developer rolls. However, as is well known, in a magnetic-brush developer, the developer rolls 39 do not directly contact the photoreceptor, but create magnetic brushes from the carrier beads, and the carrier beads contact the photoreceptor.

FIG. 3 is an elevational view of the developing station, as it would be viewed by a person servicing the apparatus. A conventional design of an electrophotographic printer, such as a copier, has the developing station situated on a carriage in the form of a pull-out drawer. The photoreceptor assembly, comprising the photoreceptor belt 10 and the associated rollers such as 14, 16, 18, and 20 shown in FIG. 1, typically flips upward on a hinge (not shown) to allow access to the developer housing: This particular design configuration of a typical copier will have significance as the invention is described in further detail.

Downstream of the developer rolls 39 is a magnetic bead removal device, or BRD, 102. Such a device includes a stationary magnet, around which the outer sleeve of the BRD rotates against the photoreceptor. As described in detail in U.S. Pat. No. 4,829,338 to Whittaker et al., the BRD uses the stationary magnet to provide a pickoff force generally near the point where the outer sleeve of the BRD is closest to the photoreceptor surface, while the magnetic field is attenuated to reduce the force of attraction as carrier beads move away from the photoreceptor surface.

Briefly, the purpose of a magnetic BRD is to remove carrier beads which adhere to the photoreceptor surface after the image is developed, by providing a steeply graded magnetic field to pull the individual carrier beads off magnetically. However, a magnetic BRD is useful only in the areas on the photoreceptor where the magnetic field is apparent. With most designs, the magnetic field of a BRD will be very weak at the edges of the photoreceptor. Most designs of a BRD include an assembly of magnetic members enveloped by a rotating sleeve which extends across and contacts the moving photoreceptor 10. However, for various reasons the magnetic members within the sleeve cannot always be designed to extend the entire length of the sleeve (i.e., the entire width of the photoreceptor 10), thus creating areas of weak magnetic field along the edges of the photoreceptor 10. Because of the weak magnetic field at the edges of the photoreceptor and the sides of the development housing 100, some carrier beads will escape the magnetic field of the BRD and eventually be carried out at the edges of the photoreceptor belt 10 into the rest of the apparatus. The specific purpose of the present invention is to keep carrier beads within the magnetic zone of the BRD so that the carrier beads may be removed magnetically by the BRD.

There can be seen in FIGS. 2 and 3 the location and configuration of two brushes 104. These brushes 104 are disposed between the developer rolls 39 and the BRD 102 adjacent either edge of the photoreceptor 10. The brushes should be so spaced from the developer roll so that they will not be abraded by the developer rolls. As the photoreceptor 10 moves against the brushes 104, the brushes serve to displace any carrier bead on the edges of the photoreceptor toward the magnetic zone of the BRD 102.

In addition to the brushes 104 of the present invention, typical designs of developer housings include shorter brushes such as shown by 110 in FIG. 3 along substantially the entire length of the developer housing, which serve to seal the developer housing in a more general sense. Because these smaller brushes do not have the requisite length or resiliency properties to push carrier beads toward the BRD 102, they have been shown to be unsuccessful in preventing carry-out of carrier beads. In the prior art, such brushes are almost invariably made of a relatively soft type of fiber.

Figure 4:
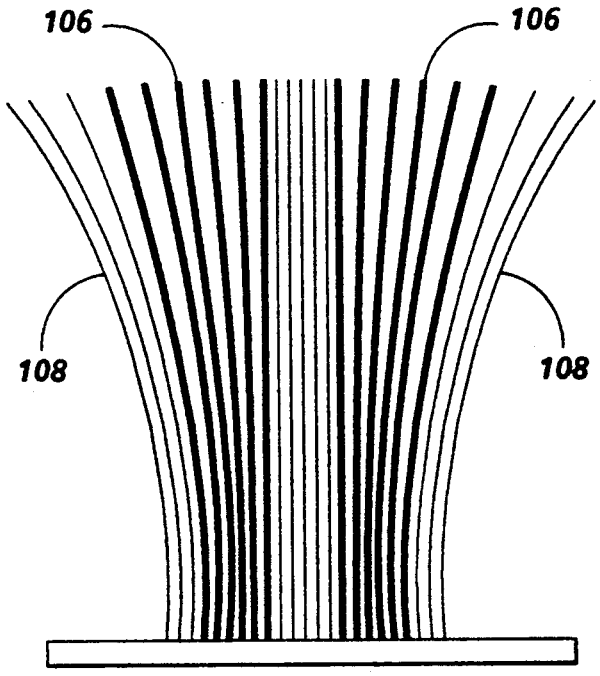
FIG. 4 is a simplified elevational view of the brush of the present invention through line 4—4 in FIG. 3 in the direction of the arrows, when the brush is free-standing.
Figure 5:
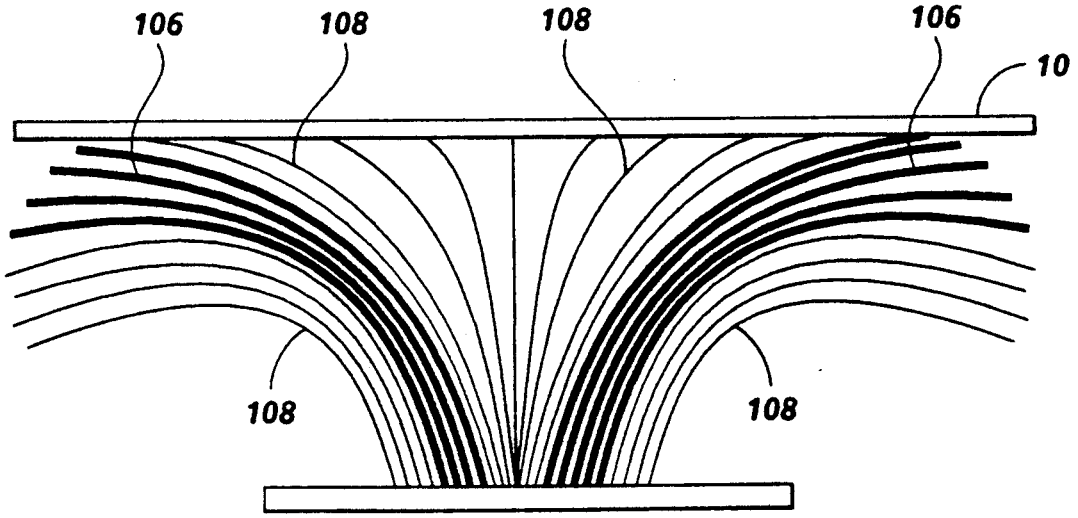
FIG. 5 is a simplified elevational view of the brush of the present invention, when the photoreceptor assembly is closed down thereon.

FIGS. 4 and 5 are two cross-sectional views through one of the brushes 104, as viewed in the direction of motion of a photoreceptor. In FIG. 4, the brush 104 is shown free-standing, and FIG. 5 shows when the brush 104 is flattened when the photoreceptor belt 10 is pushing down on it. The brush 104 is a combination of "resilient" fibers, indicated as 106, and "soft" fibers, indicated as 108. In FIG. 4 can be seen the preferred configuration of the two types of fibers within a single brush: a central row of soft fibers 108 is disposed between side rows of resilient fibers 106, and the outer sides of the rows of resilient fibers are bounded by outer rows of soft fibers. As can be seen by comparing FIG. 4 with FIG. 3, all of the rows extend in a direction parallel to the direction of motion of photoreceptor belt 10. In the preferred embodiment, all of the fibers are of a height of more than 15 millimeters.

The type of yarn to be used in the resilient fibers 106 should be distinctly resilient, in that a downward pressure on the fibers should result in an appreciable counteracting force. It has been found that the best type of fiber for this purpose is a carpet yarn made of polypropylene. The soft fibers 108 are also preferably made of polypropylene, but with smaller, rounded cross-sections. These filaments should be soft enough so as not to abrade the photoreceptor surface. Brushes made of polypropylene are typically constructed using ultrasonic welding.

In the preferred embodiment of the present invention, the soft and resilient fibers have, respectively, the following mechanical properties. The soft fibers 108 are round polypropylene threads, having a density of 1050 denier, 70 filaments per thread, and a typical diameter of 0.035 to 0.056 mm (0.0014" to 0.0022"). The resilient fibers 106 are twisted trilobal (Y-shaped) or round polypropylene threads, 2600 denier, 126 filaments per thread, with a typical base dimension of 0.055 to 0.076 mm (0.0021" to 0.0030") and typical height of 0.07–0.11 mm (0.0027–0.0043"). As used to describe Y-shaped fibers, the terms "base" and "height" relate to certain dimensions: the base is the width across the top of the letter, while the height is the dimension from the bottom to the top of the letter, when oriented so that it appears as the letter "Y".

With these dimensions and materials, the density and the cross-sectional areas of the resilient fibers should both be more than twice that of the soft fibers. This mixture of fibers provides the following benefits: firstly, the larger threads, and particularly the trilobal threads, forming the resilient fibers 106 become entangled with each other and provide larger openings between fibers than brushes made up of only smaller round fibers. Typical openings of 25 to 250 microns, under machine operating conditions, allow more efficient diffusion of toner particles through the fiber and less buildup of toner particles in the brush material. Secondly, curved trilobal shaped fibers offer more resilience in actual operating conditions due to entanglement of fibers which then mechanically support one another. Thirdly, the substantially greater cross-sectional area of the resilient fibers 106 relative to the soft fibers 108 results, in the preferred embodiment, in 8–60 times greater resilience of the resilient fibers 106 compared to the soft fibers 108, due to entanglement and a higher moment of inertia of the larger or trilobal fibers.

FIG. 5 shows the brush 104 in use, with a photoreceptor assembly pressing down on it (what is shown generally as photoreceptor surface 10 in the Figure may include an adjacent stationary surface of the photoreceptor assembly as well, depending on the specific design of the apparatus). The photoreceptor assembly pushes down on the brush 104 and splits it approximately evenly. Preferably, the edge of photoreceptor belt 10 runs along a line through the center of the brush 104. Typically, the area of contact of the brush 104 is not on an image-making portion of the photoreceptor belt 10.

When the photoreceptor surface 10, pressing down on the brush 104, is caused to move as part of the function of the apparatus, carrier beads which are adhering to the downward-facing surface of the photoreceptor 10 will be pushed into the magnetic zone of the BRD 102 by the brush fibers. The advantage of the present invention lies in the combination of resilient and soft fibers. Either type of fiber is capable of pushing carrier beads toward the BRD 102, but the soft fibers 108 are bent out of the way much more easily and are less effective, by themselves, than resilient fibers 106. However, resilient fibers 106 may abrade the surface of photoreceptor 10, including the grounding surface at the edges thereof, on the non-image-making portion of the photoreceptor 10. If the ground surface of photoreceptor 10 becomes abraded, the ground brush 25 will be unable to conduct the charge of the photoreceptor 10 to the closed-loop charging system, and the photoreceptor 10 then cannot be charged and imaged. The combination of resilient and soft fibers, however, facilitates the best properties of each type of fiber, while reducing the abrasion rate so that it is not significant.

Although the preferred embodiment described herein shows the resilient fibers in one or more central bands within the brush, many of the advantages of the present invention may be retained with other relations between the resilient and soft fibers, including a random distribution of resilient fibers 106 among the soft fibers 108.

In use, it has been found that an advisable maintenance step to be used with the brushes of the present invention is to clean the brushes 104 with a vacuum after every 500,000 to one million copies. This maintenance removes entrapped carrier beads and toner particles from the brush, restoring the resiliency force of the resilient fibers 106 against the photoreceptor.

Figure 6:
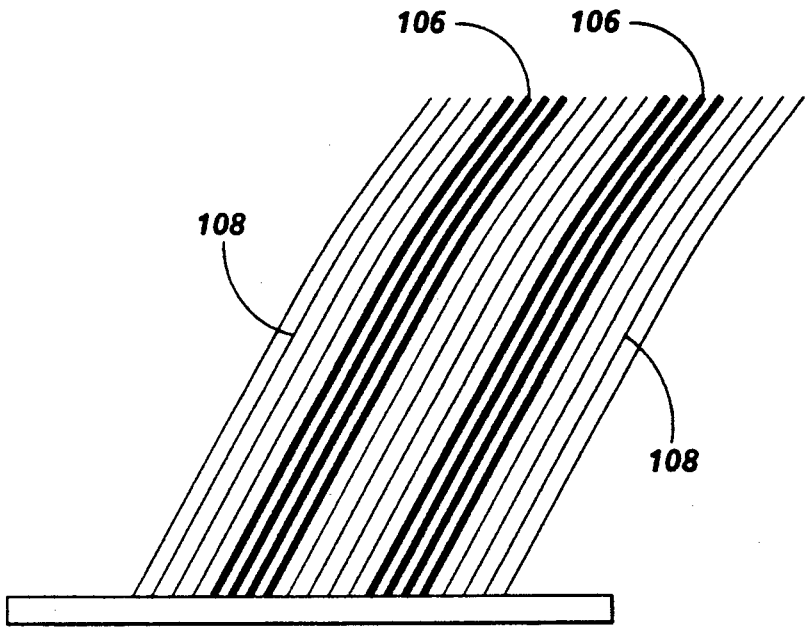
FIG. 6 is a simplified elevational view of the brush of the present invention, through line 6—6 in FIG. 3 in the direction of the arrows.

Returning to FIG. 3, wherein the developer housing 100 is shown relative to the photoreceptor assembly when the photoreceptor 10 is in its service position, pivoted above the photoreceptor housing 100 by a hinge (not shown). At the edge of the developer housing 100 near the pivot point of the photoreceptor assembly, when the photoreceptor is lowered and pressed down on the developer housing 100, the photoreceptor assembly will move past the brush and will displace fibers of the brush towards the rear of the developer housing. As mentioned above, it is significant to the successful operation of the brushes 104, that the fibers of the brush come into contact with the carrier beads on the surface of photoreceptor 10 and move them to the magnetic zone of the BRD 102. Fibers which are displaced out of the housing when the module of photoreceptor 10 is swung down cannot interact with the flow of carrier beads within the developer housing. As can be seen in FIG. 6, the fibers of the brush 104 on one side of the developer housing, adjacent the pivot of the photoreceptor assembly, are aligned not originally perpendicularly relative to the photoreceptor surface, but instead are angled inward, toward the center of the developer housing, so that, when the photoreceptor assembly is lowered onto the brush, the angle of the brush will cause the fibers which are more than 15 millimeters long to be so low as to miss the movement of photoreceptor assembly swinging down. Thus, when the printer is in actual use, the brushes 104 on both edges of the photoreceptor will be properly positioned.

While the preferred embodiment described in detail herein relates to the particular problem of removing carrier beads of a two-component electrophotographic developer from a photoreceptor surface, the invention may be modified within the scope of the appended claims to suit other purposes, such as removing toner particles of a one-component developer from a photoreceptor surface, or indeed to aid in the removal of any kind of particle from any type of surface.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. In an electrophotographic printing apparatus having a movable photoreceptor surface and developer means for conveying to the photoreceptor surface a developer material comprising carrier particles and toner material, the developer means being substantially enclosed in a developer housing, a device for preventing the migration of carrier particles out of the developer housing, comprising:

means for removing carrier particles from the photoreceptor surface, disposed substantially within the developer housing, extending substantially across the photoreceptor surface; and a brush, disposed between the developer means and the removing means, in contact with the photoreceptor surface adjacent an edge thereof, the brush including fibers of a first type and fibers of a second type, with the fibers of the second type being less resilient than those of the first type and substantially incapable of abrading the photoreceptor surface, the brush being adapted to guide the carrier particles to the removing means.

2. A device as in claim 1, wherein the fibers of the first type are substantially disposed in at least one row along the direction of movement of the photoreceptor surface, and the fibers of the second type are substantially disposed in at least one row adjacent to the at least one row of fibers of the first type.

3. A device as in claim 1, wherein the fibers of the first type and the second type are greater than 15 millimeters in length.

4. A device as in claim 1, wherein the fibers of the first type are of a density at least twice that of the fibers of the second type.

5. A device as in claim 1, wherein the fibers of the first type are of a cross-sectional area at least twice that of the fibers of the second type.

6. A device as in claim 1, wherein the fibers of the second type are in the form of filaments which are generally round in cross-section.

7. A device as in claim 1, wherein the fibers of the first type are trilobal in cross-section.

8. A device as in claim 1, wherein the fibers of the first type and the second type comprise polypropylene filaments.

9. In an electrophotographic printing apparatus having a movable photoreceptor surface and means for removing carrier particles from the photoreceptor surface, a developer unit comprising:

developer means for conveying to the photoreceptor surface a developer material comprising carrier particles and toner material; and a brush, disposed between the developer means and the removing means, in contact with the photoreceptor surface adjacent an edge thereof, the brush including fibers of a first type and fibers of a second type, with the fibers of the second type being less resilient than those of the first type and substantially incapable of abrading the photoreceptor surface, the brush being adapted to guide the carrier particles to the removing means.

10. A developer unit as in claim 9, wherein the fibers of the first type are substantially disposed in at least one row extending in the direction of motion of the surface, and the fibers of the second type are substantially disposed in at least one row adjacent to the at least one row of fibers of the first type.

11. A developer unit as in claim 9, wherein the fibers of the first type are of a density at least twice that of the fibers of the second type.

12. A developer unit as in claim 9, wherein the fibers of the first type are of a cross-sectional area at least twice that of the fibers of the second type.

13. A developer unit as in claim 9, wherein the fibers of the second type are generally round in cross-section.

14. A developer unit as in claim 9, wherein the fibers of the first type are trilobal in cross-section.

15. A developer unit as in claim 9, wherein the fibers of the first type and the second type comprise polypropylene filaments.

16. A developer unit as in claim 9, comprising a central row of fibers of the second type, two side rows of fibers of the first type on either side of the central row, and two outer rows of fibers of the second type on the sides of the side rows opposite the central row.

* * * * *